US006077326A

United States Patent [19]

Sathe

[11] Patent Number: 6,077,326

[45] Date of Patent: Jun. 20, 2000

[54] STEEL ADDITIVE FOR PROCESSING MOLTEN STEEL

[75] Inventor: Sudarshan Ramchandra Sathe, Cleveland, Ohio

[73] Assignee: Rock Creek Aluminum, Elyria, Ohio

[21] Appl. No.: 08/886,676

[22] Filed: Jul. 1, 1997

[51] Int. Cl.[7] ..... C21C 7/06

[52] U.S. Cl. ..... 75/304; 75/315; 75/568

[58] Field of Search ..... 75/304, 315, 567, 75/568

[56] References Cited

U.S. PATENT DOCUMENTS

| | | | |
|---|---|---|---|
| 1,510,745 | 10/1924 | Montgomery | 75/304 |
| 3,131,058 | 4/1964 | Ototani | 75/567 |
| 3,865,577 | 2/1975 | Gottschol et al. | 75/304 |
| 4,066,444 | 1/1978 | Kosmider . | |
| 4,097,269 | 6/1978 | Holzgruber . | |
| 4,129,439 | 12/1978 | Nashiwa et al. . | |
| 4,440,568 | 4/1984 | Staggers et al. . | |
| 4,490,172 | 12/1984 | Moore et al. . | |
| 4,750,947 | 6/1988 | Yoshiwara et al. . | |
| 4,921,533 | 5/1990 | Jackson . | |
| 5,206,475 | 4/1993 | Wada et al. . | |
| 5,286,277 | 2/1994 | Aizatulov et al. . | |
| 5,362,440 | 11/1994 | Madan et al. . | |

*Primary Examiner*—Melvyn Andrews
*Attorney, Agent, or Firm*—Fay, Sharpe, Fagan, Minnich & McKee, LLP

[57] ABSTRACT

An additive for the deoxidation of molten steel comprised of between 35 and 65 percent by weight aluminum, between 5 and 15 percent by weight silicon, and between 20 and 40 percent by weight manganese.

6 Claims, 1 Drawing Sheet

STEEL ADDITIVE FOR PROCESSING MOLTEN STEEL

BACKGROUND OF THE INVENTION

This invention relates to an additive used in the processing of molten metals, particularly steel, a process of making the additive and a process of utilizing the same. The additive of the invention is particularly well suited to be added to molten steel for the purpose of deoxidizing the steel and adjusting the composition thereof.

DESCRIPTION OF THE ART

In most common steel making processes, oxygen is blown into the liquid steel to oxidize and thereby remove excess carbon. This operation is known as the "blowing down" of carbon by using oxygen. Typically, this leaves excess oxygen in steel which, if left unscavenged, cannot only oxidize the other alloying elements but also may lead to pinholes and poor mechanical properties.

Aluminum has been widely used as a deoxidizer and grain size controller in the manufacture of steels by the hot-melt process. More particularly, aluminum acts as a sacrificial metal which binds ionic oxygen-converting it to a stable aluminum oxide which floats into the slag. Stoichiometrically, about 1 lb. aluminum reacts with about 1 lb. of oxygen to produce 2 lbs. aluminum oxide. Aluminum is a particularly desirable material for this purpose because it is on one hand quite stable at ambient temperatures and can be safely stored, handled and transported and on the other, it is extremely reactive at steelmaking temperatures.

In the conventional method, aluminum is added to the molten steel by discharging small solid masses of aluminum into the molten steel bath. Such addition is not particularly effective because of the lower specific gravity of aluminum relative to molten steel which makes the aluminum float on the steel surface and end up reacting with oxygen in air, rather than oxygen within the steel bath as it is supposed to do. Moreover, the masses of aluminum cannot penetrate into the molten steel to sufficient depth and since the aluminum reacts very quickly at the surface of the steel bath, the yield of aluminum addition is not only poor but is unpredictable in its treatment of the steel.

The term yield of aluminum addition as used herein means a ratio of the amount of aluminum contained in a product to that added to molten steel. To overcome the dilemma associated with the dissemination of the aluminum in the molten steel, efforts have been made to increase its dispersion. Within the many approaches that have been devised to counteract aluminum's inability to penetrate the steel bath to any appreciable depth due to its lower density relative to that of molten steel, one technique has been to shoot aluminum pellets (or "bullets") at a high velocity into the liquid steel mass so that the high kinetic energy of these aluminum "bullets" sufficiently counteracts the friction and force of buoyancy to reach significantly below the slag metal surface in the steel ladle. Similarly, a process is described in U.S. Pat. No. 4,066,444 wherein molten aluminum is blown into the steel melt by means of inert gasses through a lance which has been heated up to the melting point of the aluminum.

Another approach has been to make a ferro-alloy of aluminum and iron (a so-called ferro-aluminum) such that this Fe—Al alloy has much higher density than aluminum alone and can penetrate the steel bath due to this higher density. It should also be noted that the Fe—Al is usually added from some height above the steel surface and thus gains the advantage of acquiring kinetic energy in addition to the higher density and these factors, together, achieve the goal of getting the aluminum under the slag metal interface to a depth where cycling thermal currents in the ladle distribute the aluminum throughout the steel bath. Nonetheless, to achieve the appropriate density, nearly two-thirds of the slug is comprised of iron which provides neither any oxidation to the melt, nor any alloying value.

It is important to emphasize that aluminum does not necessarily have to reach the very bottom of the ladle to be effective; it simply has to get to a depth of about 2 feet below the slag-metal interface at which point the thermal currents can predominate, and move the aluminum throughout the steel bath.

In U.S. Pat. No. 4,129,439, to Nashiwa et al., it is suggested to use a ferro alloy composed of by weight 5 to 40% silicon, 40 to 80% manganese, 1 to 10% aluminum and the remainder iron. The patent clearly states that 10% aluminum is the absolute upper limit and the alloy is therefore a relatively poor oxidizing agent per unit weight for that reason. In fact, to add any significant amount of aluminum, vast amounts of accompanying silicon and manganese must be added that may result in a steel product that will satisfy only very unrestricted specifications on Si or Mn. In addition, the cost can be prohibitive. Accordingly, the present invention is directed to an improved and more effective oxidizing agent than has previously been discussed.

SUMMARY OF THE INVENTION

Accordingly, it is primary object of this invention to provide a new and improved molten steel oxidizing agent.

It is an advantage of this invention to provide an alloying agent having improved oxidizing potential relative to traditional ferro-aluminum additives.

A still further advantage of this invention is to provide an alloying agent which can be delivered in the form of a slug which is readily dispersible in a molten steel vat or ladle.

Additional objects and advantages of the invention will be set forth in part in the description which follows and in part will be obvious from the description, or maybe learned by the practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the alloying agent of the present invention is comprised of a mixture of aluminum, silicon, and manganese, wherein aluminum is between 35 and 65 weight percent, silicon is between 5 and 15 weight percent and manganese is between 20 and 40 weight percent. The present invention is also directed to a method of alloying a molten steel wherein the above-described alloying agent is added to the molten steel in a quantity sufficient to react with and thereby render harmless, a substantial portion of any free oxygen. The extent of such deoxidation is greater than a simple sum of the deoxidation that would be achieved by Al, Si, and Mn individually.

In a particularly preferred form of the invention, the additive is formed via a pressing of the constituent metal fines to form a slug wherein aluminum provides the binding properties. Most preferably, the slug is in the form of a puck having a generally cylindrical side wall and convex top and bottom surfaces.

BRIEF DESCRIPTION OF THE DRAWINGS

The invention consists in the novel parts, construction, arrangements, combinations and improvements shown and described. The accompanying drawings, which are incorporated in a constituted part of the specification illustrate one embodiment of the invention, and, together with the description, serve to explain the principles of the invention. Of the drawings.

DETAILED DESCRIPTION OF THE INVENTION

While the invention will be described in connection with the preferred embodiment, it will be understood that it is not intended to limit the invention to the embodiment. On the contrary, it is intended to cover all alternatives, modifications, and equivalents which may be included within the spirit and scope of the invention defined by the appended claims.

The aluminum-silicon-manganese (hereinafter called ALSIMN) compact of the present invention is preferably produced by pressing—rather than melting the constituents together. Moreover, the ALSIMN compact is produced by combining precise amounts of aluminum and silicon-manganese fines (preferably ¼" or smaller pieces for both) and pressing them together to make one ALSIMN piece at a time. The whole process of weighing the ingredients and compressing them into a slug is carried out repeatedly to make the multiple pieces each having exact quantities of the ingredients. In this regard, rather than depend on inconsistent analysis of other ferro alloys, the method of the present invention makes a product with precise chemistries every time. In other words, the entire manufacturing batch consists of a single piece with precise quantities of all ingredients, every time.

Figure 2:
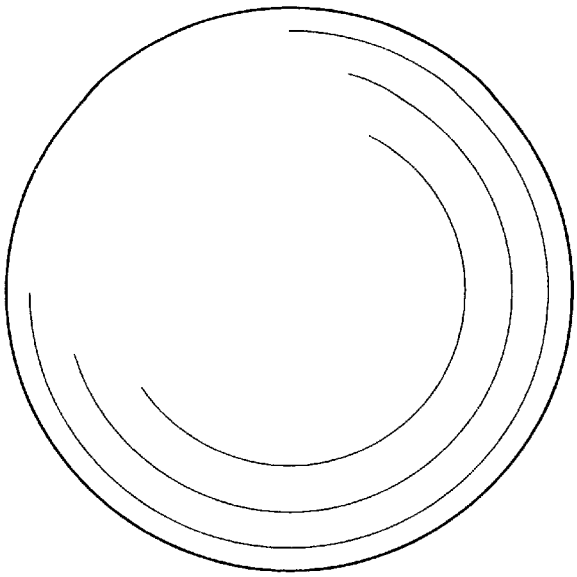
FIG. 2 is a top plan view of the slug of FIG. 1.
Figure 1:
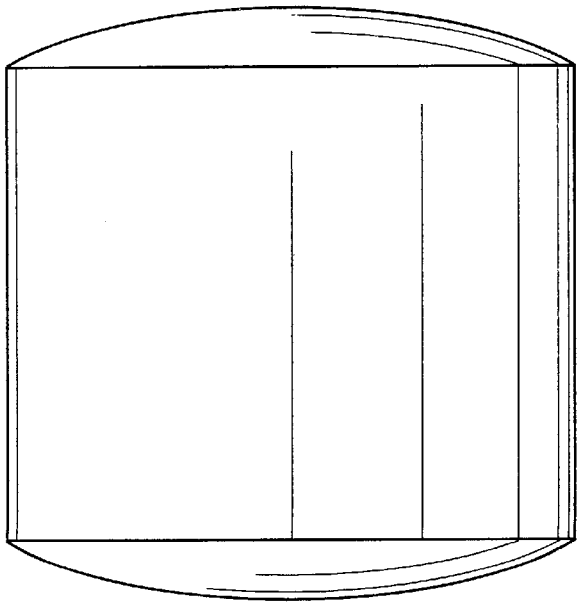
FIG. 1 is a side elevation view of the inventive steel additive slug.

The composition of ALSIMN is between 35 and 65% aluminum, preferably 45–55% aluminum, and the balance is silicon-manganese. The reason for the absolute lower limit of 35% aluminum is that below this quantity the deoxidation potential of this additive would not be commercially viable. A CL-100 press equipped with weigh hoppers is used to make the ALSIMN compact. The weigh hoppers containing aluminum fines and Si—Mn fines, individually discharge about 8 oz. each, in quick succession, into a trough. Acceptable silicon-manganese fines have the general components Mn 62%; Si 20%, C 2%, P<1% and S<0.5%. Of course, both the aluminum fines and the silicon-manganese may include any number of residual elements. The trough then tumbles the combined material into the compression chamber wherein a ram compresses the mixture with approximately 1500 lbs. of compressing force. If the "footprint" (the area over which this force is distributed) is too large, it would result in lower pressure (lbs./sq. in.) and vice-versa. The present procedure balances the competing requirements of maintaining sufficient pressure for compaction integrity with that of achieving commercially viable production levels. In other words, a very small diameter would afford extremely good compaction but result in very low production rate whereas large diameter of the compact may provide high production rate at the expense of density and strength of the compact. In a preferred embodiment, diameter of 2.75" was chosen as the optimum. A special die that creates a noticeable bulge on each of the flat sides of a cylindrical compact was devised to give the product a shape which does not result in bridging if conveyed via bulk handling equipment. This preferred form of the invention is displayed in FIGS. 1 and 2.

The ALSIMN compacts are preferably added to the molten metal in the ladle or furnace or at any other time desired by the skilled artisan. The compacts may be added by a sophisticated automatic system or simply manually thrown into the melt.

Thus, it is apparent that there has been provided in accordance with the invention, an iron alloying agent that fully satisfies the objects, aim, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. An aluminum silicon-manganese compact for the deoxidation of molten steel consisting of between 35 and 65 percent by weight aluminum, between 5 and 15 percent by weight silicon, between 20 and 40 percent by weight manganese and optionally carbon, phosphorous, sulfur or other impurities.

2. The compact of claim 1 wherein said aluminum comprises between about 45 and 55 percent by weight.

3. The compact of claim 1 wherein said silicon comprises between about 8 and 12 percent by weight and manganese comprises between 25 and 35 percent by weight.

4. The compact of claim 1 wherein iron is an additional component in the composition.

5. The compact of claim 1 in the form of a slug including a cylindrical sidewall and convex top and bottom surfaces.

6. An aluminum silicon-manganese compact for the deoxidation of molten steel consisting of between 35 and 65 percent by weight aluminum, between 5 and 15 percent by weight silicon, and between 20 and 40 percent by weight manganese.

* * * * *